US008739987B2

(12) United States Patent
Martin et al.

(10) Patent No.: US 8,739,987 B2
(45) Date of Patent: Jun. 3, 2014

(54) METHOD AND DEVICE FOR ATTACHING AND REMOVING AN ADDITIONAL DEVICE TO THE MAIN BOOM OF A MOBILE CRANE

(75) Inventors: Michael Martin, Illingen (DE); Roland Kuhn, St. Ingbert (DE); Udo Biwer, Nonnweiler (DE)

(73) Assignee: Terex Demag GmbH (DE)

( * ) Notice: Subject to any disclaimer, the term of this patent is extended or adjusted under 35 U.S.C. 154(b) by 881 days.

(21) Appl. No.: 12/712,447

(22) Filed: Feb. 25, 2010

(65) Prior Publication Data

US 2010/0213152 A1 Aug. 26, 2010

(30) Foreign Application Priority Data

Feb. 26, 2009 (DE) ..... 10 2009 010 452

(51) Int. Cl.
*B66C 23/70* (2006.01)

(52) U.S. Cl.
USPC ..... 212/177; 212/347

(58) Field of Classification Search
CPC ..... B66C 23/00; B66C 23/34; B66C 23/346; B66C 23/344; B66C 23/36; B66C 23/365; B66C 23/70; B66C 23/64; B66C 23/66; B66C 23/68; B66C 23/82; B66C 23/90; B66C 25/00; B66C 27/01
USPC ..... 212/175, 177, 270, 347
See application file for complete search history.

(56) References Cited

U.S. PATENT DOCUMENTS

| | | | | | |
|---|---|---|---|---|---|
| 2,529,454 | A * | 11/1950 | Marcantonio | ..... | 212/300 |
| 2,595,897 | A * | 5/1952 | Shoemaker | ..... | 212/172 |
| 3,085,695 | A * | 4/1963 | Miller | ..... | 212/300 |
| 3,794,184 | A * | 2/1974 | Higgins | ..... | 212/295 |
| 4,386,711 | A * | 6/1983 | Gattu et al. | ..... | 212/303 |
| 5,199,586 | A * | 4/1993 | Pech et al. | ..... | 212/175 |
| 5,217,344 | A * | 6/1993 | Gendrault et al. | ..... | 414/729 |
| 5,960,970 | A * | 10/1999 | Walker | ..... | 212/294 |
| 6,213,318 | B1 * | 4/2001 | Walker | ..... | 212/177 |
| 6,516,917 | B1 * | 2/2003 | Mayer et al. | ..... | 182/17 |
| 2006/0065616 | A1 * | 3/2006 | Diehl | ..... | 212/300 |

* cited by examiner

*Primary Examiner* — William E Dondero
*Assistant Examiner* — Nathaniel Adams
(74) *Attorney, Agent, or Firm* — Cantor Colburn LLP

(57) ABSTRACT

A method and a device for attaching and removing an additional device having individual elements to and from a main boom of a mobile crane using no auxiliary crane is provided. In the method, a partial piece of the additional device having partial pieces is raised into an inclined position while being rotated about an upper pivot point, and a head of the main boom is bolted to a lower end of the inclined end of the partial piece of the additional device facing the mobile crane so as to be able to rotate. Using a hoist cable, all partial pieces are raised in alignment with respect to each other and the main boom, and are bolted to each other in this position and to the main boom. A displacement device for carrying out the method is also provided.

6 Claims, 3 Drawing Sheets

METHOD AND DEVICE FOR ATTACHING AND REMOVING AN ADDITIONAL DEVICE TO THE MAIN BOOM OF A MOBILE CRANE

CROSS REFERENCE TO RELATED APPLICATION

This application claims the benefit of German patent application No. 10 2009 010 452.6 filed Feb. 26, 2009 the contents of which are incorporated herein by reference thereto.

FIELD OF THE INVENTION

The invention relates to the attachment and removal of an additional device to and from the main jib of a mobile crane, which is to be done without the use of an auxiliary crane.

BACKGROUND

It is known how in mobile cranes, particularly telescoping cranes, to attach an additional device to the head of the main jib of the base crane. Such a device is used to achieve a jib length that extends even further beyond the maximum jib length of the telescoping crane. The devices are generally designed as modular systems and can be combined as a function of required length or lifting capacity.

Ideally, the individual main elements of the device have a lattice/pipe design in transportable dimensions. The device elements are joined with pins at corresponding points to form a single unit.

In most cases, the additional device will not be carried together with the base crane and must be transported separately. Devices provided specially for this purpose, however, may also be carried together with the base crane, weight and space conditions permitting. The attachment to the main boom head can occur piece by piece, or as a preassembled unit in a known manner with an additional auxiliary crane.

The use of an auxiliary crane entails additional costs because it requires additional personnel to move it close to the setup location. In addition, it is difficult to guide the freely floating and raised additional device with pinpoint precision to the fastening points provided at the jib head of the mobile crane, while keeping the risk of injury for the installers in mind. This means a relatively high expenditure of time for installation.

It is therefore an object of the invention to simplify the attachment of the additional device and make it safer, in particular, to carry it out without the use of an additional auxiliary crane.

SUMMARY

In an exemplary embodiment, a method for attaching and removing a preassembled additional device comprising individual elements, to and from the main boom of a mobile crane comprises placing the preassembled additional device, which may have a lattice/pipe design in transportable dimensions, on the ground in alignment with the main boom of the mobile crane. A partial piece, at the end of the additional device facing the mobile crane, is raised into an inclined position while being rotated about an upper pivot point and is held in this position. A head of the preassembled additional device is bolted to the lower end of the inclined end of the partial piece of the additional device facing the mobile crane so as to rotate and, the additional device is pulled into a horizontal position using a hoist cable fastened on the end of a second partial piece raised in an inclined position, at the end of the preassembled additional device facing away from the mobile crane, and guided over a roller, such that the second partial piece of the preassembled additional device, the remaining parts of the preassembled additional device, and the main boom of the mobile crane are aligned behind one another in orientation. The components are connected to each other and to the head of the main boom by bolting them thereto.

The above features and advantages, and other features and advantages of the present invention are readily apparent from the following detailed description when taken in connection with the accompanying drawings.

BRIEF DESCRIPTION OF THE DRAWINGS

Other objects, features, advantages and details appear, by way of example only, in the following detailed description of the embodiments, the detailed description referring to the drawings in which.

DESCRIPTION OF THE EMBODIMENTS

Figure 1:
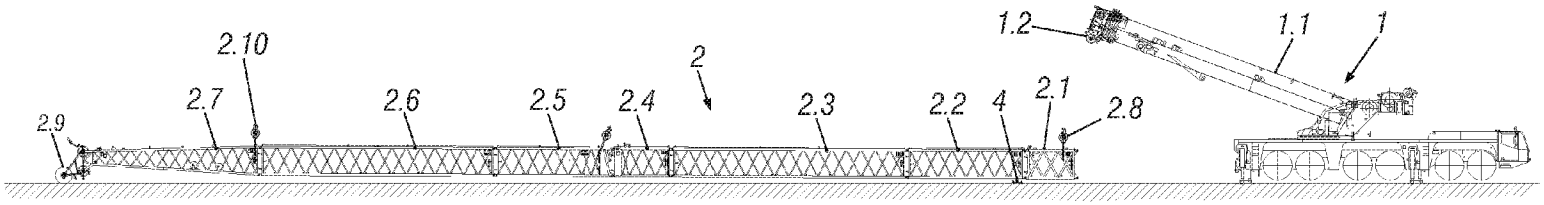
FIGS. 1 to 5 illustrate the attachment, according to the invention, of the additional device, with angling of the two partial pieces of the additional device.

The following description is merely exemplary in nature and is not intended to limit the present disclosure, application or uses. It should be understood that throughout the drawings, corresponding reference numerals indicate like or corresponding parts and features.

Using the mobile crane 1, the additional device 2 may be assembled from several individual elements 2.1 to 2.7 in the desired configuration and placed on the ground in axial alignment with the main boom 1.1 of the mobile crane 1. The end of the additional device 2 facing the mobile crane 1, as is shown in FIG. 1, is placed on the displacement device 4 , (FIGS. 7, 10 and 11), with the individual element 2.2 and oriented with respect to the main boom by displacement.

Figure 2:
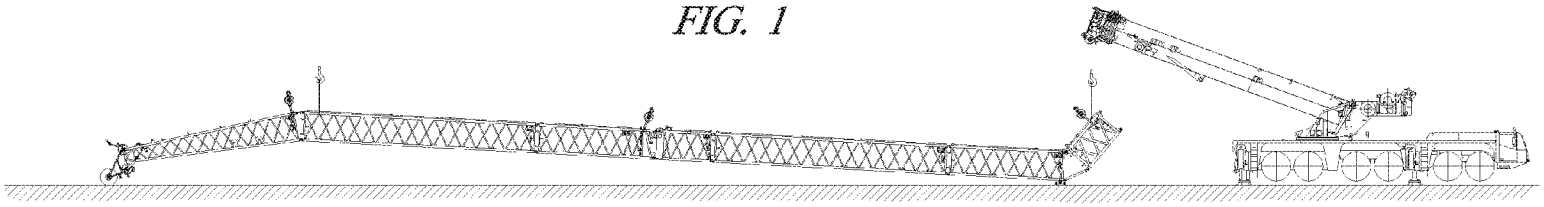
Figure 8:
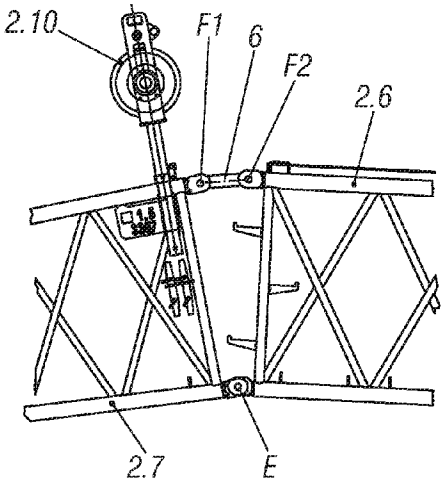
FIG. 8 illustrates the details of the partial piece of the additional device marked with "FIG. 8" in FIG. 3 in an inclined position.
Figure 7:
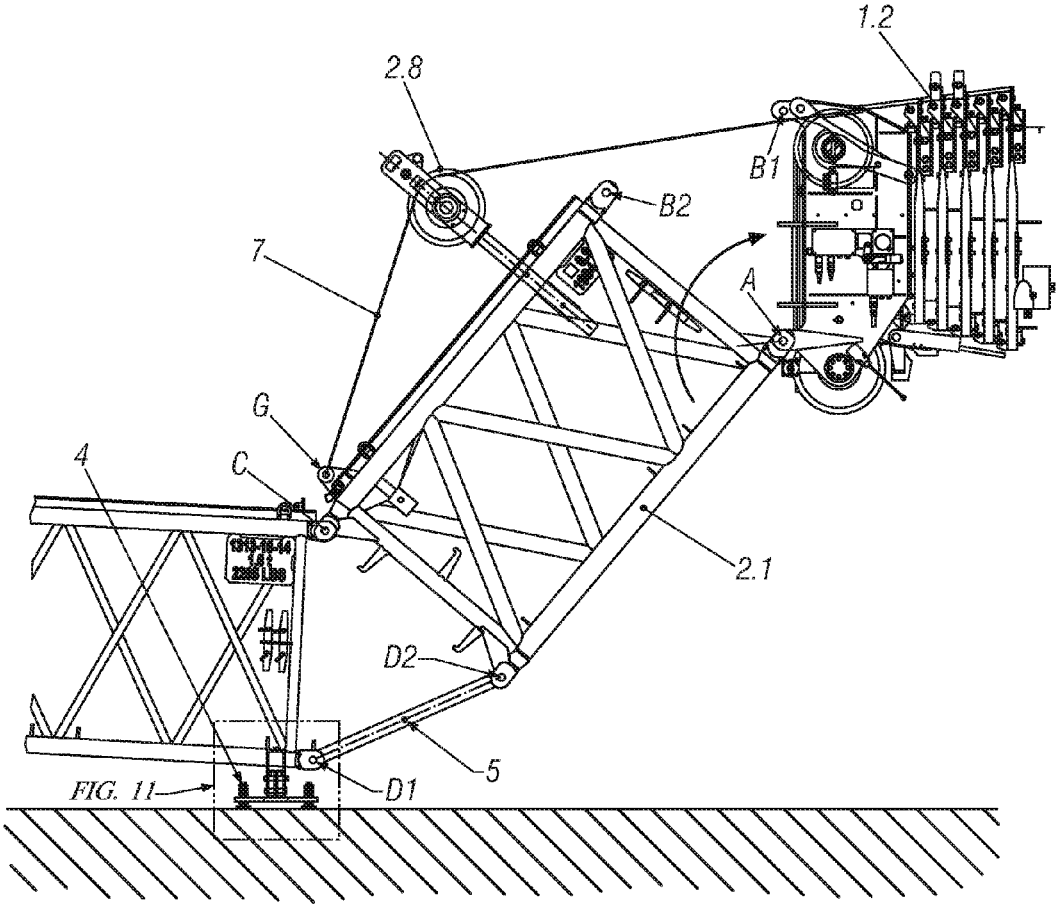
FIG. 7 illustrates the details of the partial piece of the additional device marked with "FIG. 7" in FIG. 3 in an inclined position.

A first partial piece 2.1 of the additional device, also referred to as the head connection, is then raised with the crane 1,(FIGS. 2 and 7), and thereby rotated upward about point C (FIG. 7) and a spacer rod 5 is introduced between points D1 and D2 for fixing the inclined position of the partial piece 2.1. Thereafter, a second partial piece 2.7, also referred to as the tip or distal end of the additional device facing away from the mobile crane is rotated downward about point E (FIG. 8) into an inclined position by raising the additional device 2, and a spacer rod 6 (FIG. 8) is inserted between points F1 and F2 for fixing the inclined position. The angled position of the tip of the additional device 2 is required for establishing the horizontal alignment with the main boom 1.1 of the mobile crane 1 to allow subsequent bolting at point B (FIG. 7).

Figure 11:
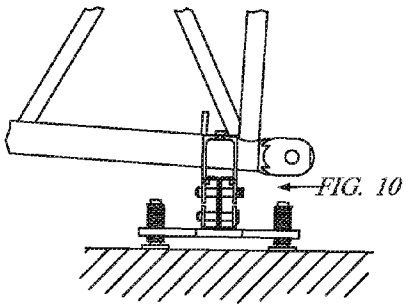
FIG. 11 illustrates the direction of displacement in a side view.
Figure 10:
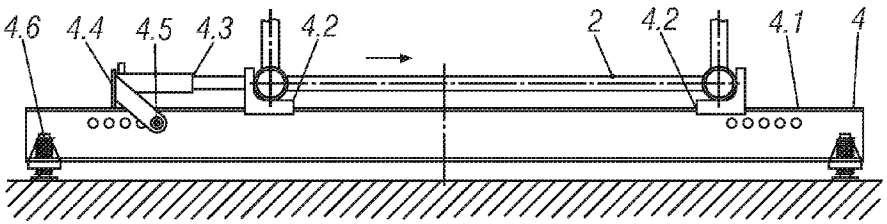
FIG. 10 illustrates the direction of displacement in a front view.

The main boom head 1.2 is guided close to the inclined first partial piece 2.1 and bolted to it at point A. The orientation of the parts with respect to each other and the alignment of the bores in point A are made possible by moving the main boom 1.1 and by displacing the additional device 2 using the displacement device 4 (FIGS. 10 and 11). After the bolting at point A, the spacer rod 5 can be removed.

Figure 3:
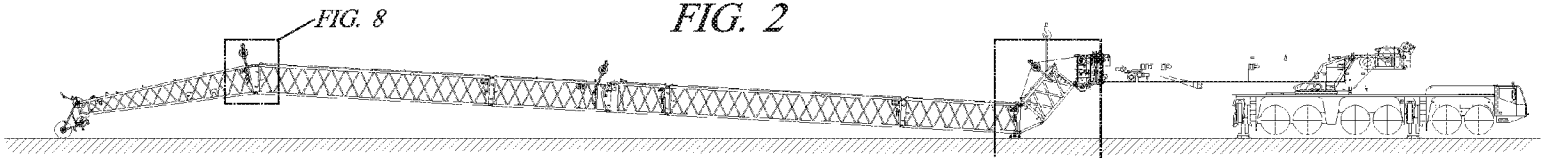

A hoist cable 7 of the crane is guided over the roller 2.8 (FIGS. 3 and 7) and attached at point G. By retracting the hoist cable 7, the first partial piece 2.1, that is hinged at points A and C, rotates so far upward until point B1, at the head of the main boom, can be bolted to point B2 of the partial piece 2.1. In the raised state of the device, point D1 at the device element 2.2 can also be connected to point D2 at the partial piece 2.1. The result is the state illustrated in FIG. 4.

Figure 4:
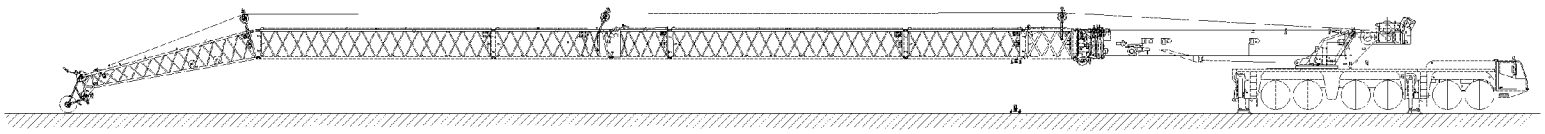
Figure 5:
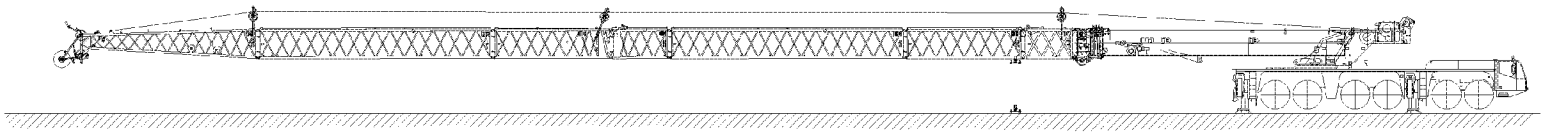
Figure 9:
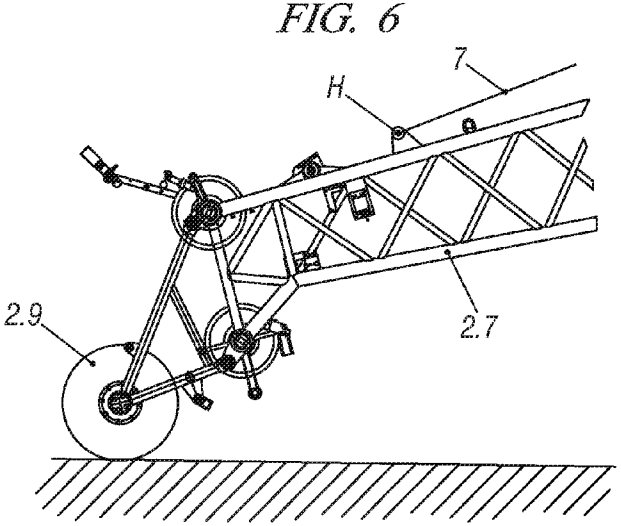
FIG. 9 illustrates the design of the end piece of the additional device with the wheel.

In order to enable removal of the spacer rod 6, the main boom with 1.1 the additional device 2 located in front of it is rocked or raised until the wheel 2.9 is just about to lift off the ground. The bolted connection at points F1 and F2 is thereby relieved and can be detached, and the bolt connection of the spacer rod 6 can be released, and the rod removed. The hoist cable 7 is now fastened at point H by way of the roller 2.10 (FIGS. 4 and 9). By retracting the hoist cable, the second partial piece 2.7 of the additional device 2 is rotated about point E (FIG. 8), thereby lifting off the ground until points F1 and F2 can be bolted together. After bolting, the hoist cable is detached from point H and attachment of the additional device 2 to the main boom 1.1 of the mobile crane 1. The removal of the additional device is carried out in reverse order.

In an exemplary embodiment, the inclined positions of the first and second partial pieces 2.1 and 2.7 of the additional device 2 could also be brought about by a cylinder or a similar apparatus instead of raising the hoist cable.

Figure 6:
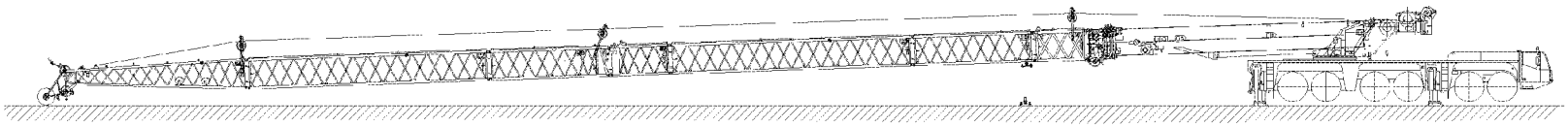
FIG. 6 illustrates the attached additional device without prior angling of the partial piece of the additional device facing away from the mobile crane.

In another exemplary embodiment, the raising of the additional device and the fixed inclined position of the second partial piece 2.7 can be eliminated, if the main boom 1.1 can be angled so far down (subsurface position see FIG. 6) or if the entire crane can be inclined such that the tip of the device 2 in the finished, attached state of the device had contact with the ground via the wheel 2.9.

An exemplary embodiment of the displacement device 4 is illustrated in FIGS. 10 and 11. The additional device 2 is located on the two sliding pieces 4.2 of the displacement device 4 which can slide on a main jib 4.1. Using the piston rod of the lifting cylinder 4.3, the sliding pieces 4.2 with the additional device 2 placed thereon are pushed over the sliding plane of the main jib 4.1 into the desired position. The cylinder bearing 4.4 is fastened to the main jib 4.1, using a locking pin 4.5, to the right or left of the additional device 2, depending on the required direction of displacement. An adjustment in the vertical direction can be carried out using the height-adjustable feet 4.6.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the present application.

The invention claimed is:

1. A method for attaching and removing an additional device to and from a main boom of a mobile crane using no auxiliary crane, the additional device comprising a plurality of individual elements defining a first end and a second end, the plurality of individual elements including a first partial piece and a second partial piece, the first partial piece extending from the first end to an adjacent first individual element of the plurality of individual elements and coupled to the adjacent first individual element and configured to be coupled to the main boom, and the second partial piece extending from the second end to an adjacent second individual element of the plurality of individual elements and coupled to the adjacent second individual element, the method comprising:

placing the additional device on the ground in alignment with the main boom of the mobile crane such that the first end faces a head of the main boom;

raising the first partial piece at the first end so that the first partial piece is raised into an inclined position by rotating about an upper pivot point;

holding the first partial piece in the inclined position;

bolting the head of the main boom to a lower end of the first partial piece so that the first partial piece, in the inclined position, is rotatable relative to the adjacent first individual element of the plurality of individual elements;

pulling the additional device into a horizontal position using a hoist cable fastened to the second partial piece;

connecting the additional device to the head of the main boom; and placing the first partial piece of the additional device onto a displacement device, configured to transversely displace a longitudinal axis of the additional device, into alignment with a longitudinal axis of the main boom of the mobile crane.

2. The method according to claim 1, wherein the plurality of individual elements of the additional device has a multi-piece lattice/pipe design, of transportable dimensions.

3. The method according to claim 1, wherein the inclined position of the first partial piece is secured by a spacer rod.

4. The method according to claim 1, further comprising;

raising the additional device, at the adjacent second individual element of the plurality of individual elements such that a second partial piece of the additional device, rotatable about a lower pivot point, assumes an inclined position with one side of the second partial piece maintaining contact with the ground prior to raising the first partial piece of the additional device;

raising the first partial piece of the additional device such that the first partial piece rotates relative to the adjacent first individual element about the upper pivot point;

raising the second partial piece of the additional device by pulling a lifting cable that is fastened to a head point of the second partial piece of the additional device such that the first and second partial pieces of the additional device, the plurality of individual elements and the main boom of the mobile crane are aligned; and connecting second partial piece, the plurality of individual elements and the first partial piece to each other and to the head of the main boom.

5. The method according to claim 4, wherein the raising and inclining of the first and second partial pieces of the additional device is carried out using a hoist cable of the mobile crane.

6. The method according to claim 4, wherein the raising and inclining of the first and second partial pieces of the additional device is carried out using a lifting cylinder.

* * * * *